US010555571B2

(12) United States Patent
Biddle

(10) Patent No.: US 10,555,571 B2
(45) Date of Patent: Feb. 11, 2020

(54) BODYBUILDING COMPETITION SUIT NUMBERS TAB

(71) Applicant: Rebecca Romig Biddle, Pittsburgh, PA (US)

(72) Inventor: Rebecca Romig Biddle, Pittsburgh, PA (US)

( * ) Notice: Subject to any disclaimer, the term of this patent is extended or adjusted under 35 U.S.C. 154(b) by 151 days.

(21) Appl. No.: 15/624,868

(22) Filed: Jun. 16, 2017

(65) Prior Publication Data

US 2018/0360145 A1 Dec. 20, 2018

(51) Int. Cl.

| | |
|---|---|
| ***A41D 27/08*** | (2006.01) |
| ***A41B 9/00*** | (2006.01) |
| *G09F 21/02* | (2006.01) |

(52) U.S. Cl.

CPC ..... *A41D 27/08* (2013.01); *A41B 9/002* (2013.01); *G09F 21/02* (2013.01)

(58) Field of Classification Search

CPC ..... A41B 9/002; A41D 27/08
USPC ..... 2/67, 94, 69, 69.5, 244
See application file for complete search history.

(56) References Cited

U.S. PATENT DOCUMENTS

| | | | | | |
|---|---|---|---|---|---|
| 5,119,979 | A * | 6/1992 | Kallman | G02C 3/04 | 2/271 |
| 5,581,815 | A * | 12/1996 | Hans | A41D 13/0015 | 2/115 |
| 5,797,145 | A * | 8/1998 | Levinson | A41F 9/007 | 2/227 |
| 5,987,650 | A * | 11/1999 | Carroll | A41D 7/00 | 2/104 |
| 2011/0004978 | A1* | 1/2011 | Gwaltney | A41B 9/001 | 2/402 |
| 2012/0216326 | A1* | 8/2012 | Van Kuren | A41D 27/08 | 2/69 |

* cited by examiner

*Primary Examiner* — Katherine M Moran
(74) *Attorney, Agent, or Firm* — Dunlap Bennett & Ludwig PLLC

(57) ABSTRACT

A bodybuilding competition suit number tab is provided. The suit number tab embodies a tubular tab of stretch material for securing a competition number to a competition suit without fear of damaging the suit, or making the competitor uncomfortable during competition, or the number falling off. The tubular tab may be formed by folding a sheet of stretch material so that opposing ends generally align, and then joining the opposing ends. The tubular tab may then be inverted and joined to a bottom portion of the competition suit before connecting the competition number to the tubular tab, utilizing the space provided by the lumen of the tubular tab.

9 Claims, 3 Drawing Sheets

32
12
30
14
31

14
12

14
26
16
26
12

12
10
16
12
14

10
12
60
14

BODYBUILDING COMPETITION SUIT NUMBERS TAB

BACKGROUND OF THE INVENTION

The present invention relates to bodybuilding competition suits and, more particularly, to a bodybuilding competition suit number tab.

Bodybuilding competition suits, especially for women, purposefully use minimal amounts of fabric in order to showcase the competitor's prowess. As a result, bodybuilding competition suits have no designated location on which their competition number can be securely pinned without damaging the suit itself, hurting the competitor, or the number falling off.

As can be seen, there is a need for a bodybuilding competition suit number tab providing a secure place for a competitor to secure their competition number without fear of damaging the suit, making themselves uncomfortable during competition, or the number falling off.

SUMMARY OF THE INVENTION

In one aspect of the present invention, a bodybuilding competition suit number tab may include a sheet of stretch material forming a tubular shape providing a lumen therethrough, wherein the tubular shape is attached to a bottom portion of a competition suit, wherein the tubular shape extends for approximately three quarters of an inch, and wherein the lumen has a diameter of approximately one quarter inch.

In another aspect of the present invention, a system for connecting a number sheet to a competition suit provides a competition suit of a predetermined stretch material having a bottom portion, wherein the bottom portion is adapted to be worn around a waist of a human wearer; an attachment point provided by the bottom portion, wherein the attachment point is located on an upper left hand side of a front portion of the waist of the wearer; and a tubular shaped tab of the predetermined stretch material attached at the attachment point.

In yet another aspect of the present invention, a method of making a competition suit number tab for a competition suit, includes the steps of providing the competition suit of a predetermined stretch material; providing a sheet of the predetermined stretch material having a first surface and an opposing second surface; folding said sheet so that opposing ends thereof are generally aligned; joining the opposing ends along a join segment, forming a tubular shape of the predetermined stretch material; and trimming the tubular shape so that is extends for approximately three quarters of an inch, and in certain embodiments the step of inverting the tubular shape so that the join segment is within a lumen of the tubular shape.

These and other features, aspects and advantages of the present invention will become better understood with reference to the following drawings, description and claims.

DETAILED DESCRIPTION OF THE INVENTION

Figure 1:
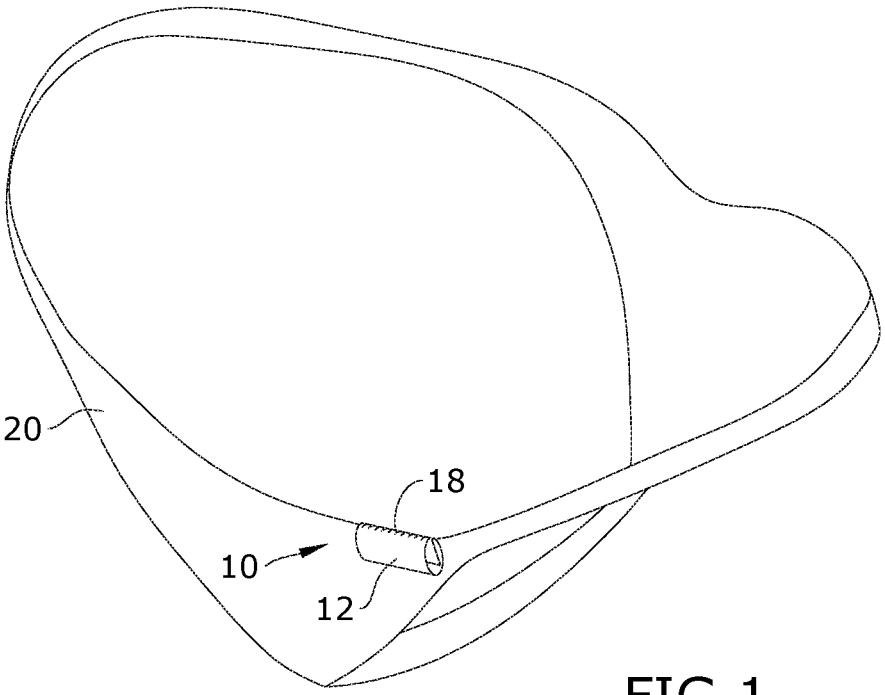
FIG. 1 is a perspective view of an exemplary embodiment of the present invention attached to a competition suit 20.
Figure 2:
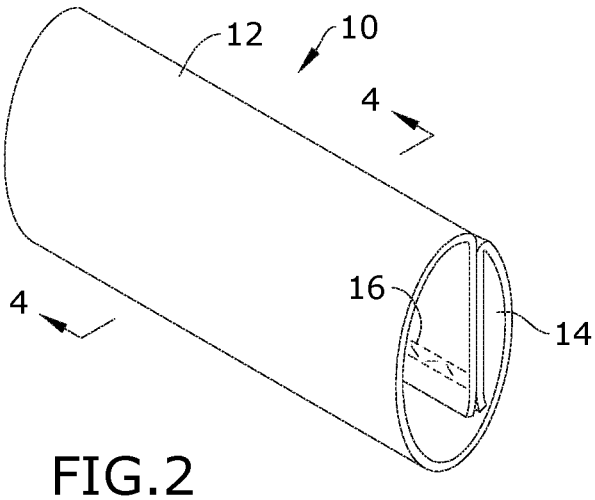
FIG. 2 is a perspective view of an exemplary embodiment of the present invention.
Figure 3:
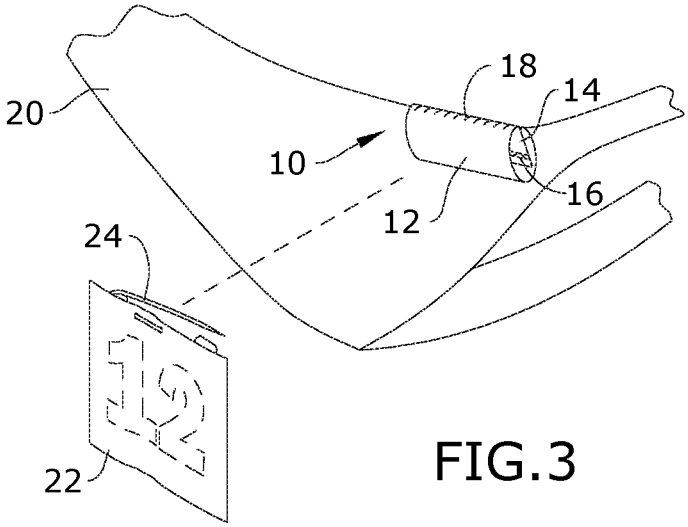
FIG. 3 is a perspective view of an exemplary embodiment of the present invention, illustrating attachment of a connector 24.
Figure 4:
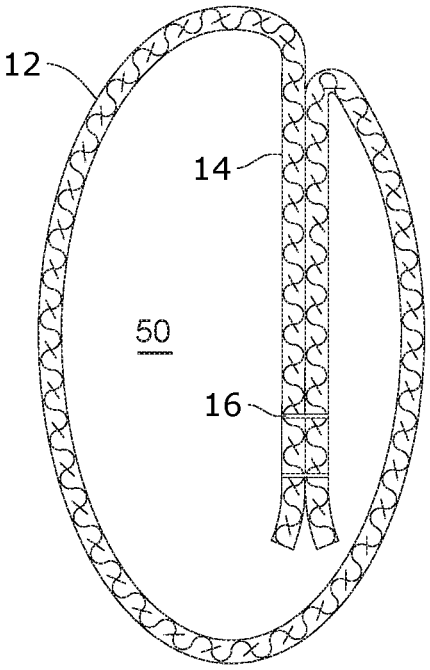
FIG. 4 is a section view of an exemplary embodiment of the present invention, taken along line 4-4 of FIG. 2.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a bodybuilding competition suit number tab embodying a tubular tab of stretch material for securing a competition number to a competition suit without fear of damaging the suit, or making the competitor uncomfortable during competition, or the number falling off. The tubular tab may be formed by folding a sheet of stretch material so that opposing ends generally align, and then joining the opposing ends. The tubular tab may then be inverted and joined to a bottom portion of the competition suit before connecting the competition number to the tubular tab, utilizing the space provided by the lumen of the tubular tab.

Referring to FIGS. 1 through 5E, the present invention may include embody a tubular tab 10 and a method of making and using the same. The tubular tab 10 may be made from a sheet of material 30 so that the tubular tab 10 matches the corresponding material of an associated competition suit 20. Such material may be synthetic fabric or a synthetic-natural combination that has elastic properties, or "stretch fabric", such as spandex, or the like. The tubular tab 10 is dimensioned and adapted to attach a competition number sheet 22 thereto via a connector 24, such as a pin or the like. As a result, in certain embodiments, the tubular tab 10 has approximately a ¼ inch diameter and a length of ¾ inch.

Figures 5A, 5B, 5C, 5D, 5E:
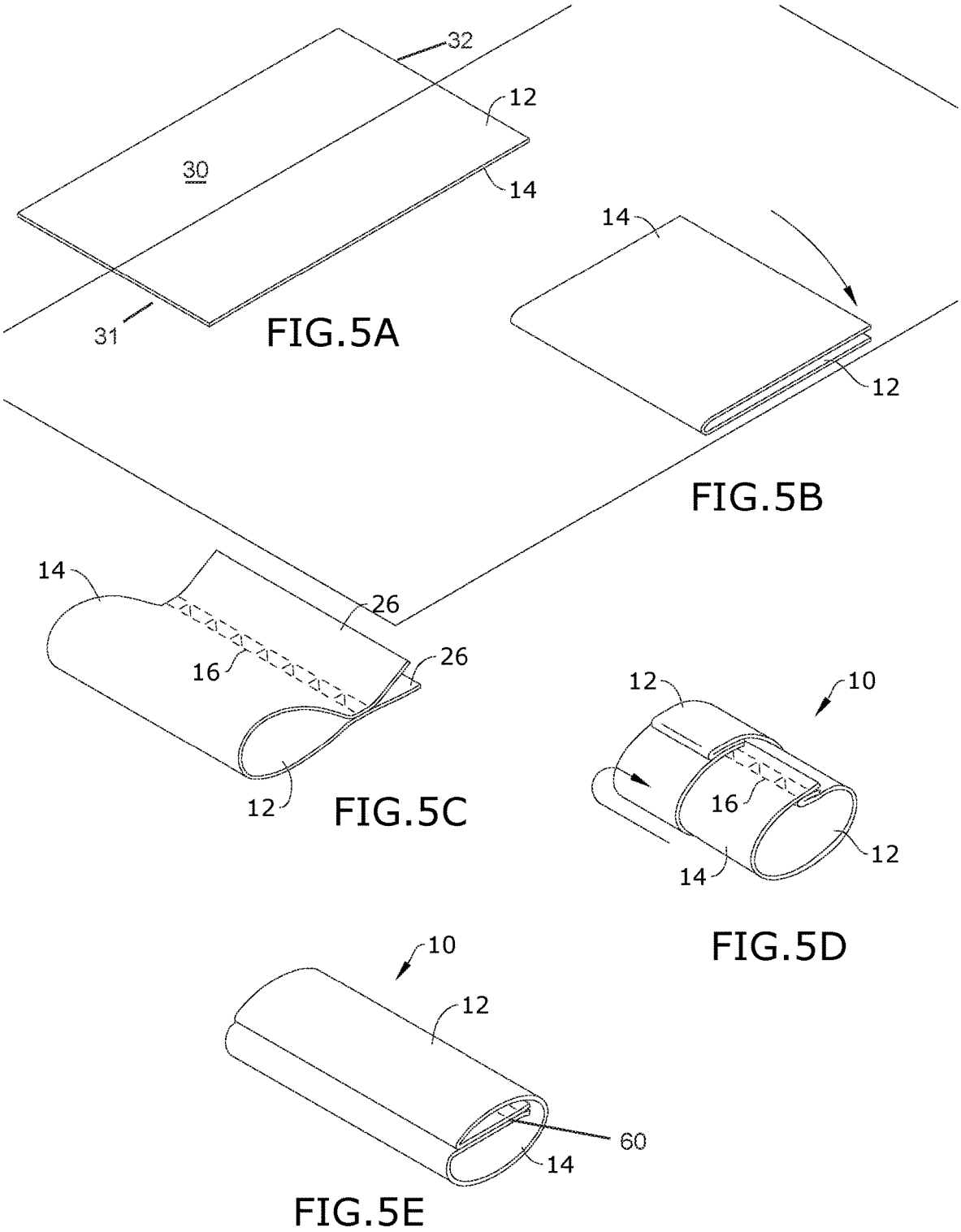
FIG. 5A is a perspective view of an exemplary embodiment of the present invention, prior to manufacture, laid flat.
FIG. 5B is a perspective view of an exemplary embodiment of the present invention, illustrating an initial folding of a sheet of material 30.
FIG. 5C is a perspective view of an exemplary embodiment of the present invention, illustrating forming a tubular shape.
FIG. 5D is a perspective view of an exemplary embodiment of the present invention, illustrating inverting of the tubular shape.
FIG. 5E is a perspective view of an exemplary embodiment of a completed loop of the present invention.

A method of making the present invention may include the following steps. The sheet of material 30 may be provided, defined by a first surface 12 and an opposing second surface 14. The sheet of material 30 may be generally rectangular or elongated, extending between a first edge 31 and a second edge 32. The sheet of material 30 may be folded in half, as illustrated in FIG. 5B, so that the first and second edges 31 and 32 are generally aligned and the first surface 12 is self-facing. Then the user may join the sheet of material 30 at or just inward of the first and second edges 31 and 32 by a first joiner 16 along a join segment 60 so that the remaining portion of the sheet of material may form a tubular shape, as illustrated in FIG. 5C. The elastic properties of the stretch fabric maintain a lumen 50 of the tubular tab 10. Any excess portion 26, between the first joining point and the first and second edges 31 and 32, may be trimmed. Then the joined sheet of material 30 may be inverted, as illustrated in FIG. 5D, so that the self-facing first surface 12 is outward facing, and the join segment 60 is within the lumen 50. The join segment 60 may provide a flange. At this time the tubular tab 10 may be ironed flat. Once the tubular tab 10 is created, a portion thereof may then joined by a second joiner 18 to the top left hand side of a bottom portion of the competition suit 20, leaving the lumen 50 unobstructed for connecting the connector 24. The first and second joiners 16 and 18 may be sewing applied by needle and thread.

The tubular tab may be made while constructing the fabric straps and ties that are required for the competition suits 20, and then snipped off the ends of such fabric straps.

A method of using the present invention may include the following steps. The tubular tab 10 disclosed above may be provided. A user may utilize the connector 24 to attach the number sheet 22 to the tubular tab 10. In certain embodiments, the user may weave the pin 24 in and out of the tubular tab 10, utilizing the lumen 50, before closing the pin/connector 24 in order to further secure it. Wherein the lumen 50 affords ease of such weaving and initial connection of the connector 24 in the first place, which is a boon since the sizes of the above-mentioned elements.

It should be understood, of course, that the foregoing relates to exemplary embodiments of the invention and that modifications may be made without departing from the spirit and scope of the invention as set forth in the following claims.

What is claimed is:

1. A tubular tab for retaining a sheet to a competition suit, comprising:

a competition suit;

a first sheet having an elongated connector; and a second sheet of stretch material forming a tubular tab providing a lumen therethrough, wherein the tubular tab is attached to a bottom portion of a competition suit, wherein the lumen has an inner periphery related to a length of the elongated connector so that the elongated connector may be woven in and out of the tubular tab before closing the elongated connector, whereby the first sheet can be securely connected indirectly to the competition suit without damaging the competition suit.

2. The tubular tab for retaining a sheet to a competition suit of claim 1, wherein a tubular shape has a length of three quarters of an inch.

3. The tubular tab for retaining a sheet to a competition suit of claim 2, wherein the lumen has a diameter of one quarter inch.

4. The tubular tab for retaining a sheet to a competition suit of claim 1, wherein the first sheet includes a competition number.

5. The tubular tab for retaining a sheet to a competition suit of claim 1, wherein the first sheet is a number sheet.

6. A system for connecting a number sheet to a competition suit, comprising:

a competition suit of a predetermined stretch material having a bottom portion, wherein the bottom portion is adapted to be worn around a waist of a human wearer;

an attachment point provided by the bottom portion, wherein the attachment point is located adjacent to an upper left hand side of a front portion of the waist of the human wearer when the bottom portion is worn; and a number sheet having an elongated pin connector;

a tubular tab attached at the attachment point;

the tubular tab shaped from the predetermined stretch material to define a lumen having an inner periphery related to a length of the elongated pin connector so that the elongated pin connector may be woven in and out of the tubular tab before closing the elongated pin connector, whereby the number sheet can be securely pinned indirectly to the competition suit without damaging the competition suit.

7. The system of claim 6, wherein a tubular shape provides a lumen has a length of three quarters of an inch.

8. The system of claim 7, wherein the lumen has a diameter of one quarter inch.

9. The system of claim 6, wherein the number sheet includes a competition number.

* * * * *